US010234196B2

(12) United States Patent
McCloud

(10) Patent No.: US 10,234,196 B2
(45) Date of Patent: Mar. 19, 2019

(54) HAIR EXTENSION DRYING DEVICE

(71) Applicant: Tiarra McCloud, Ft. Washington, MD (US)

(72) Inventor: Tiarra McCloud, Ft. Washington, MD (US)

(73) Assignee: Beaute' Innovante, Inc., Ft. Washington, MD (US)

( * ) Notice: Subject to any disclaimer, the term of this patent is extended or adjusted under 35 U.S.C. 154(b) by 214 days.

(21) Appl. No.: 15/058,551

(22) Filed: Mar. 2, 2016

(65) Prior Publication Data

US 2017/0254588 A1 Sep. 7, 2017

(51) Int. Cl.

| | |
|---|---|
| ***A45D 1/04*** | (2006.01) |
| ***F26B 9/06*** | (2006.01) |
| ***A41G 5/00*** | (2006.01) |
| ***F26B 3/04*** | (2006.01) |
| ***F26B 21/00*** | (2006.01) |
| ***F26B 25/00*** | (2006.01) |
| ***F26B 25/06*** | (2006.01) |
| ***F26B 25/12*** | (2006.01) |

(52) U.S. Cl.

CPC ..... *F26B 9/06* (2013.01); *A41G 5/004* (2013.01); *F26B 3/04* (2013.01); *F26B 21/001* (2013.01); *F26B 25/003* (2013.01); *F26B 25/06* (2013.01); *F26B 25/12* (2013.01)

(58) Field of Classification Search

CPC ... A45D 1/04; A45D 1/06; A45D 1/08; A45D 1/14; A45D 1/28

USPC ..... 34/101, 96; 551/101, 96

See application file for complete search history.

(56) References Cited

U.S. PATENT DOCUMENTS

| | | | | |
|---|---|---|---|---|
| 2011/0232122 | A1* | 9/2011 | Butler | |
| 2013/0068708 | A1* | 3/2013 | Johnson | A47F 1/12 211/59.3 |
| 2016/0374447 | A1* | 12/2016 | Sterling | A45D 20/08 34/275 |
| 2017/0105501 | A1* | 4/2017 | Palmer | A45D 20/04 |

* cited by examiner

*Primary Examiner* — John McCormack

(74) *Attorney, Agent, or Firm* — Jason T. Daniel, Esq.; Daniel Law Offices, P.A.

(57) ABSTRACT

A device for drying hair extensions includes an elongated main body having a hinged door and an interior space. A blower unit having a fan and a heat element are positioned along the top end of the main body and function to deposit forced air into the interior space. A hanger unit is positioned within the interior space and aligns hair extensions beneath the forced air to dry the same.

9 Claims, 7 Drawing Sheets

HAIR EXTENSION DRYING DEVICE

TECHNICAL FIELD

The present invention relates generally to hair products, and more particularly to a drying device for hair extensions.

BACKGROUND

The statements in this section merely provide background information related to the present disclosure and may not constitute prior art.

Hair extensions are becoming one of the most popular ways for people to quickly and easily improve or change the look of their hair. In this regard, hair extensions may be used to add length, thickness and/or color to a person's existing hair. There are many different types of commercially available hair extensions, such as strand by strand extensions and weft extensions, for example.

Strand by strand extensions typically involve the fusing of individual or small groups of extensions to the existing hair strand(s) on the person, by way of adhesives or light/heat radiation, whereas other methods involve braiding strand extensions to existing hair strands prior to fusing the strands. Conversely, weft extensions typically involve the attachment of a weft of hair (i.e., a curtain of hair attached together at the top and free flowing at the bottom) to the person. The most popular methods for attaching the weft include weaving and/or braiding existing hair through the weft, or using a clip or other type of attachment mechanism.

With particular regard to waft extensions, it is important to regularly wash and condition the hair extension, in order to prolong the life of the device. Once the extensions have been cleaned, they must then be thoroughly dried. Owing to the delicate nature of hair extensions, the drying process typically requires the user to carefully brush and blow dry the weave, in order to prevent the strands from becoming entangled.

Although useful for preventing damage to the extensions, this process is laborious and extremely time consuming. As such, it would be beneficial to provide a self-contained hair extension drying device which can automatically dry any type of hair extension, without damaging or entangling the extension strands, and without suffering from the drawbacks described above.

SUMMARY OF THE INVENTION

The present invention is directed to a device for drying hair extensions. One embodiment of the present invention can include an elongated main body having a hinged door and an interior space. A blower unit can be positioned along the top end of the main body and can function to deposit forced air into the interior space. A hanger unit can be positioned within the interior space and can function to receive and suspend a plurality of hair extensions beneath the output of the blower unit, in order to dry the extensions.

In various embodiments, the blower unit can include one or both of a fan and a heating element so as to blow room temperature air and/or heated air into the interior space of the main body.

In yet another embodiment, the device can include an internal controller having an input/output mechanism for allowing a user to control the functionality of the blower unit. To this end, a user can select how long the unit runs before shutting off, and/or the temperature of the generated air.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
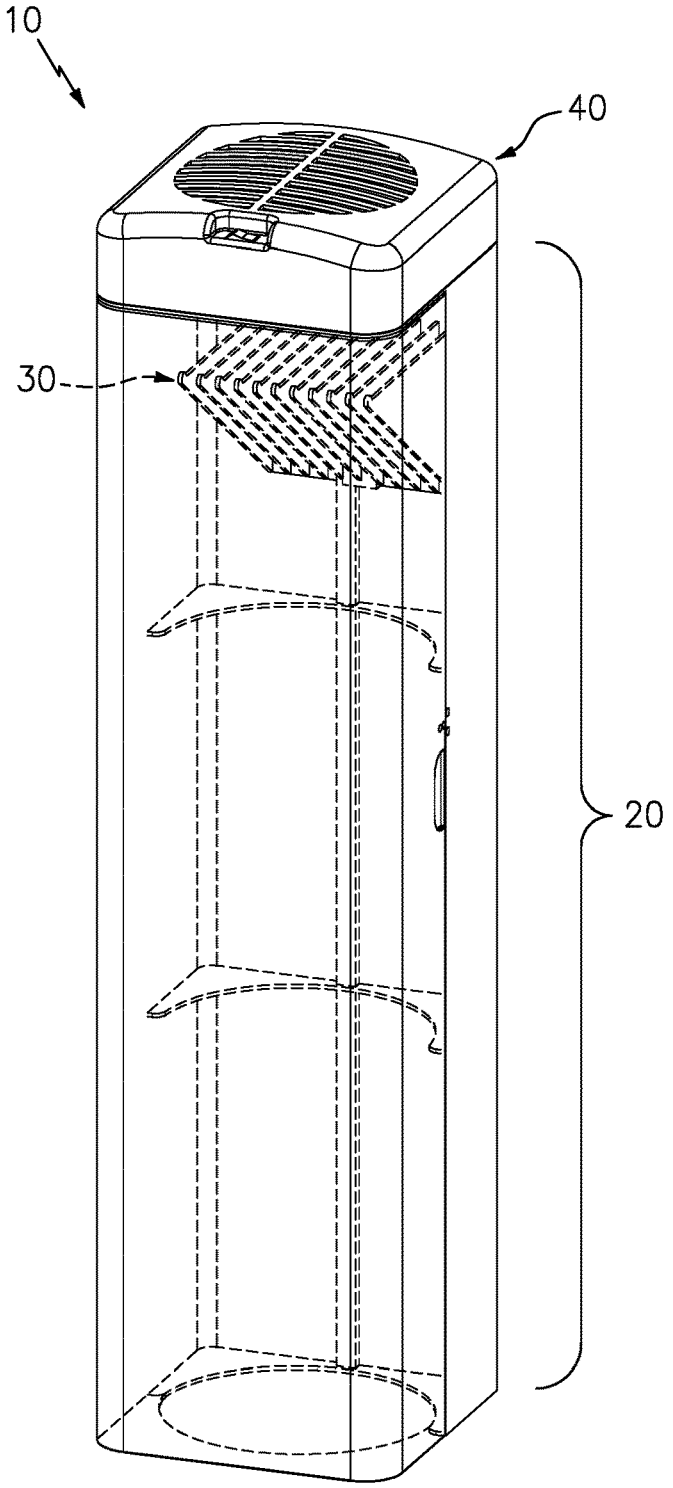
FIG. 1 is a perspective view of the hair extension drying device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a hair extension drying device 10 that is useful for understanding the inventive concepts disclosed herein. As shown, the device 10 can include, essentially, a main body 20 having an internal hanger unit 30, and a blower unit 40.

Figure 2:
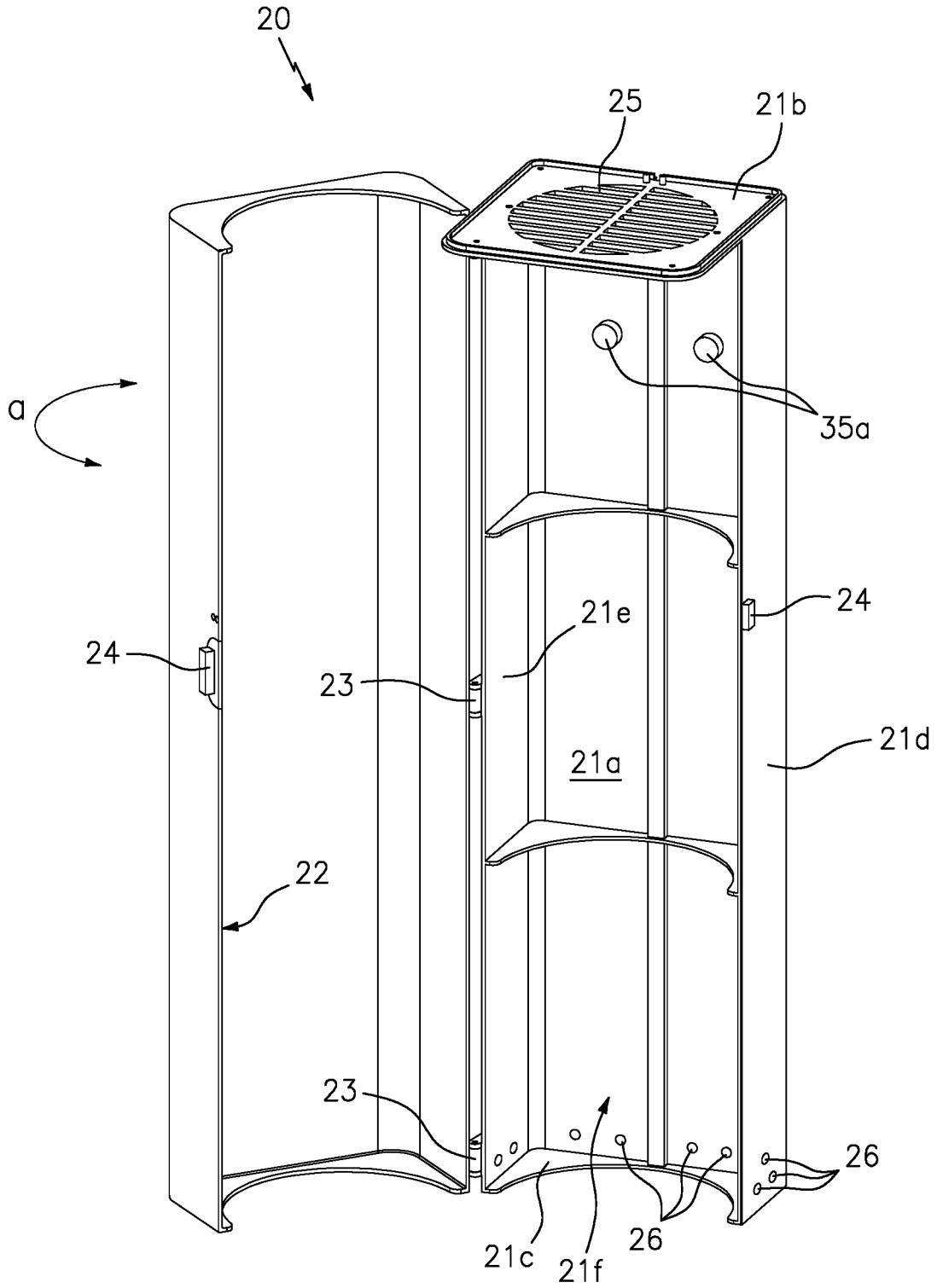
FIG. 2 is a perspective view of the main body of the hair extension drying device, in accordance with one embodiment of the invention.

As shown best in FIG. 2, the main body 20 can include an elongated member having a back wall 21*a*, a top wall 21*b*, a bottom wall 21*c*, and a pair of opposing side walls 21*d* and

21*e*, forming a hollow interior space 21*f*. A door 22 can be hingedly secured 23 along one of the side walls, so as to transition (see arrow a) between the closed configuration shown in FIG. 1 and the open configuration shown in FIG. 2, thereby respectively preventing and allowing access to the hollow interior space.

In various embodiments, one or more latching mechanisms 24, can be provided along one or both of the door 22 and side wall(s), in order to maintain the door in the closed position. Door latching mechanisms are extremely well known and can include any type of clip, latch and/or the use of magnetic elements, for example.

In one embodiment, a central aperture 25 can be disposed along the top wall 21*b*. As will be described below, the aperture 25 can function to allow the air generated by the blower unit 40 to pass into the interior space 21*f*. Likewise, one or more exhaust apertures 26 can be disposed along the main body. The exhaust apertures can function to allow the received air to pass through the interior space, thereby ensuring continuous airflow over the inserted hair extensions located within the interior space 21*f*.

In the preferred embodiment the main body 20 can include the illustrated rectangular shape, and can be constructed from a lightweight durable material such as plastic, for example. To this end, the door 22 can preferably be clear, so as to allow a user to view the interior space 21*f* during device operation. Of course, the door need not be secured by a hinge, and can be removable in nature. In such an embodiment, the illustrated hinges can be replaced with additional latching mechanisms.

Although dimensions are not critical, one preferred embodiment of the main body will include a height (e.g., distance between the top wall 21*b* and the bottom wall 21*c*) of approximately 26 inches, a width (e.g., distance between the opposing side walls 21*d* and 21*e*) of approximately 5.5 inches, and a depth (e.g., distance between the door 22 and the back wall 21*a*) of approximately 5 inches. Such dimensions being suitable for accommodating the most commonly produced hair extensions having lengths ranging from approximately 10 inches to 25 inches.

Although described above with respect to a particular shape, size and/or construction material, this is for illustrative purposes only, as any number of other different shapes, sizes and/or construction materials may be utilized.

Figure 3:
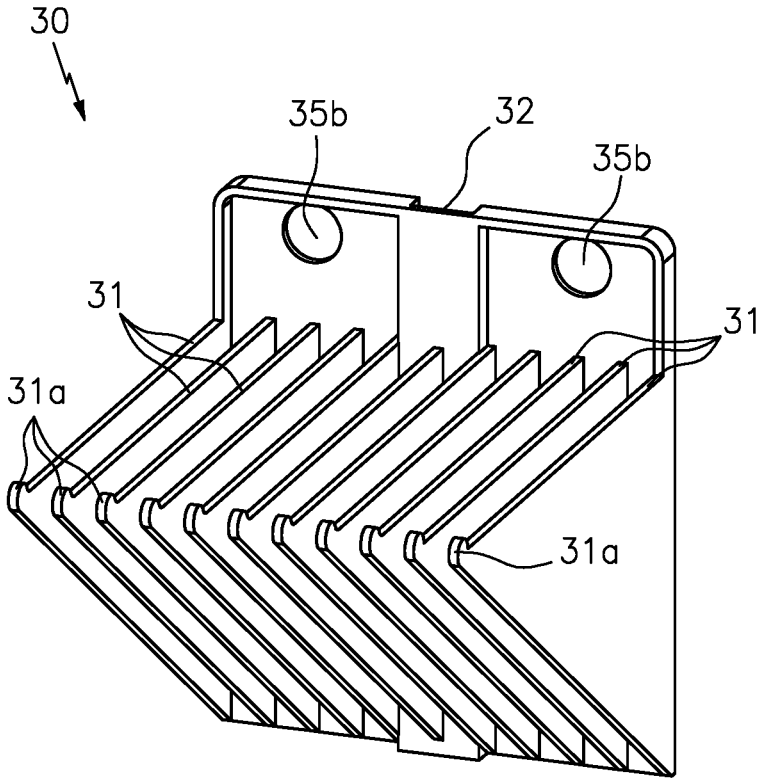
FIG. 3 is a front view of the hanger unit of the hair extension drying device, in accordance with one embodiment of the invention.

FIG. 3 illustrates one embodiment of a hanger unit 30, which can function to receive hair extensions and orient the same within the main body. In the preferred embodiment, the hanger 30 can include a plurality of slats 31 that extend diagonally outward from a generally planar mounting plate 32. As shown, each of the slats preferably include a raised stopper portion 31*a* along the distal end, to prevent the hair extensions from sliding off of the hanger during use.

By providing a plurality of elongated and generally parallel-oriented slats, the internal hanger can receive a weft (or other) type hair extension, and separate the individual strands of hair, thereby allowing each strand to receive air from the blower unit. Moreover, by positioning the slats diagonally, relative to the aperture 25, the hanger 30 advantageously utilizes gravity to assist the airflow from the blower unit to remove moisture from the extensions. In this regard, moisture that accumulates onto the slats can be directed down and away from the hair extension.

The hanger will include a dimension that is capable of being positioned within the interior space of the main body when the door is closed, and is positioned so as to directly receive the air generated by the blower unit. In this regard, the hanger 30 can be permanently secured within the main body, or can be removably secured thereto. To this end, each of the main body 20 and the mounting plate 32 can include a connector 35*a* and a complementary connector 35*b*, respectively. As described herein, the terms "connector," and "complementary connector" (including derivatives thereof) can include or comprise any number of different elements capable of working together to repeatedly secure two items together in a nonpermanent manner (i.e., removably secured).

Several nonlimiting examples include, but are not limited to, opposing strips of hook and loop material (i.e. Velcro®), magnetic elements, tethers such as straps and ties, compression fittings such as hooks and eyelets, snaps and buttons, and/or opposing strips of magnetic elements, for example. Each illustrated connector and/or complementary connector can be permanently secured to the illustrated portion of the device via a permanent sealer such as glue, adhesive tape, or can be integrated in to the manufacturing process so as to form a permanent element thereof.

Although described above with respect to a particular shape, this is for illustrative purposes only, as any number of different shapes are also contemplated. In addition to the above, one embodiment of the hanger 30 can be constructed from a heat absorbing material such as metal, for example, so as to further heat the hair extensions resting thereon during operation of the blower unit. Of course, any number of other construction materials are also contemplated.

Figure 4:
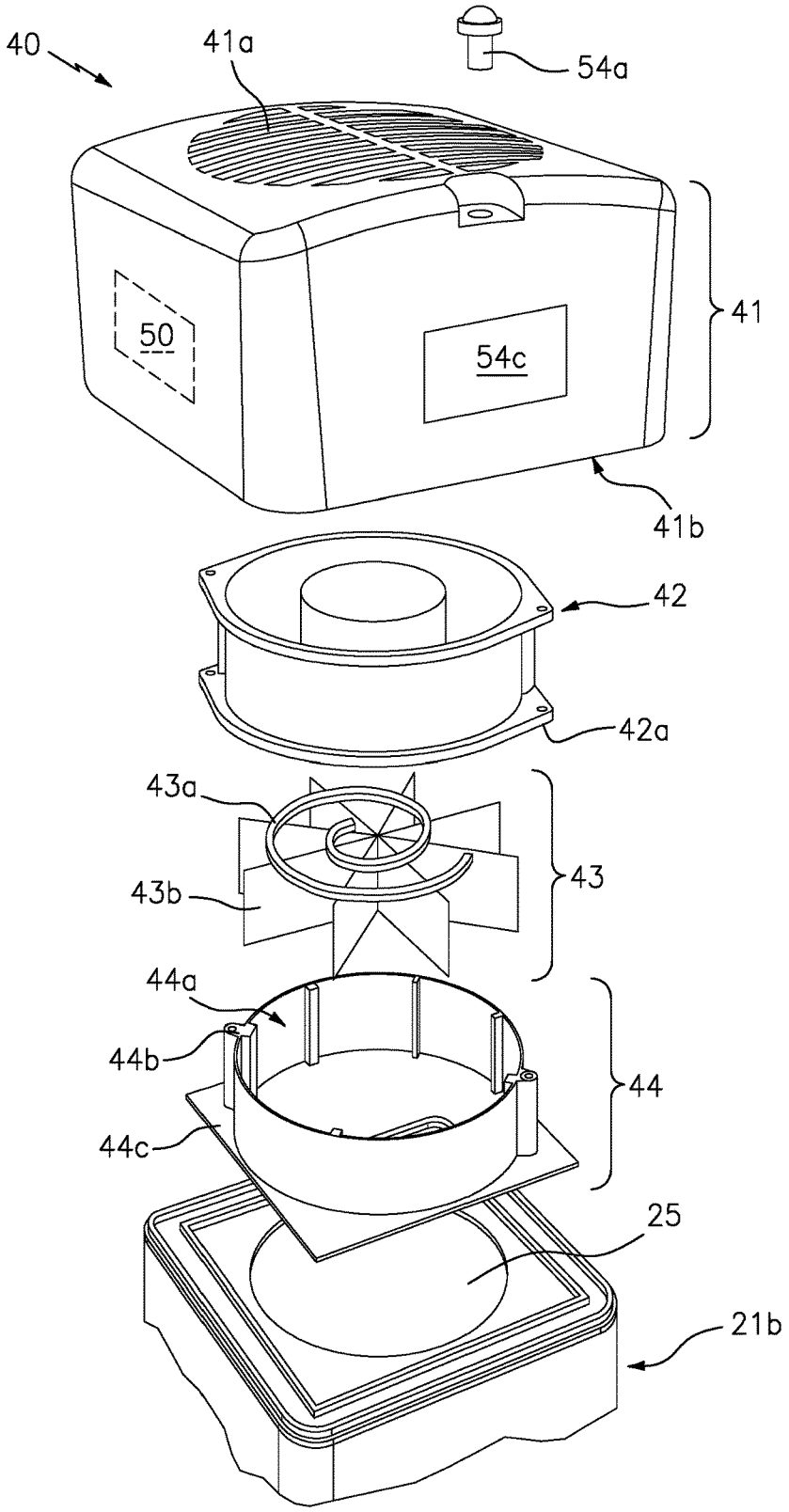
FIG. 4 is an exploded parts view of the blower unit of the hair extension drying device, in accordance with one embodiment of the invention.

FIG. 4 is an exploded parts view of one embodiment of the blower unit 40. As shown, the blower unit can include a generally hollow housing body 41 having a series of air inlets 41*a* along the top end, and an open bottom end 41*b* for receiving a fan 42, a heating element 43, a heater bracket 44, and an internal controller 50.

The fan 42 can include virtually any type of A/C or DC powered fan having a plurality of blades which spin about a central axis to generate airflow. The heating assembly 43 can include a central coil 43*a* and a plurality of heat channels 43*b* that are positioned adjacent to the fan output via the heater bracket 44.

As shown, the bracket 44 includes a central aperture 44*a* that is defined by an upper surface 44*b* having a shape and size that is complementary to the bottom end of the fan 42*a*, and a generally square bottom end 44*c* having a shape and size that is complementary to the bottom end of the housing 41*b*.

In this regard, when the blower unit is fully assembled, each of the fan 42, heating element 43, heater bracket 44, and internal controller 50 can be positioned within the housing body 41. At this time, the assembled blower unit can be mounted onto the top of the main body 20, wherein the bottom of the aperture 44*a* functions as a blower output and is aligned with the central aperture 25 of the main body, so as to deposit the forced convection air generated by the fan 42 and heat coil 43 into the interior space 21*f*.

Figure 5:
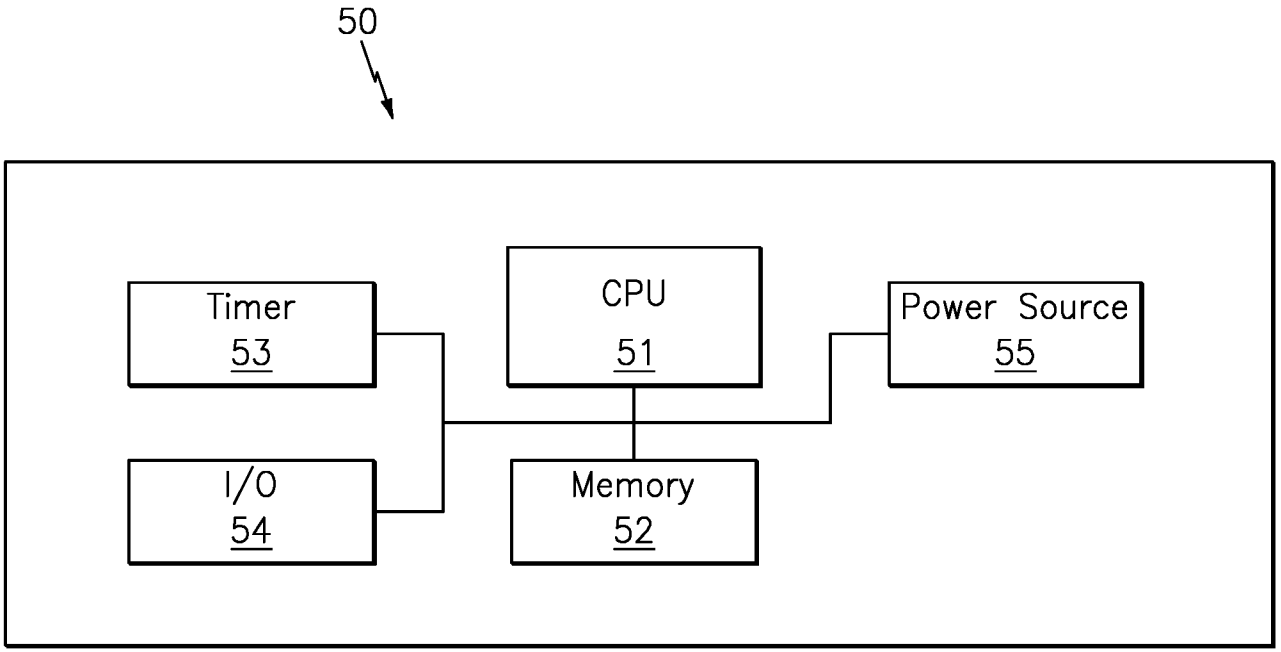
FIG. 5 is a simplified block diagram of the internal controller of the hair extension drying device, in accordance with one embodiment of the invention.

FIG. 5 illustrates one embodiment of a blower unit controller which can function to control an operation of the device. As shown, the controller 50 can include a processor 51 that is conventionally connected to an internal memory 52, a timer module 53, an input/output unit 54, and a power source 55.

Although illustrated as separate elements, those of skill in the art will recognize that one or more system components may be, or include one or more printed circuit boards (PCB) containing an integrated circuit or circuits for completing the activities described herein. The CPU may be one or more integrated circuits having firmware for causing the circuitry to complete the activities described herein. Of course, any number of other analogue and/or digital components capable of performing the below described functionality can be provided in place of, or in conjunction with the below described controller elements.

The processor/CPU 51 can act to execute program code stored in the memory 52 in order to allow the device to perform the functionality described herein. Likewise, a timer module 53 can be provided, and can function to accurately measure the passage of time. As described herein, the timer module can be provided as a function of the processor or can include a separate physical circuit. In either instance, processors and timers are extremely well known in the art, therefore no further description will be provided.

Memory 52 can act to store operating instructions in the form of program code for the processor 51 to execute. Although illustrated in FIG. 5 as a single component, memory 52 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 51 can also include one or more cache memories that provide temporary storage of at least some program code in order to reduce the number of times program code must be retrieved from the bulk storage device during execution. Each of these devices are well known in the art.

The power unit 55 can preferably include an A/C electrical power transformer and cord (not illustrated) capable of allowing the device to be powered from a standard electrical outlet. Of course, other embodiments are also contemplated wherein the power source can include a plurality of batteries. Such a feature can be integrated into a smaller size main body so as to create a portable version of the device for use while traveling, for example.

The input/output unit 54 can be provided to accept user inputs and/or to provide operating information to a device user. In various embodiments, the input/output unit can include one or more pushbuttons 54*a*, that are connected to the processor 51 so as to activate the blower unit for a predetermined period of time, such as 15 minutes, for example. Likewise, one or more lights 54*b* can also be provided to clearly indicate whether the device is in the ON or OFF operating state. Moreover, the input/output unit can include or comprise a visual display such as a touch screen Graphic User Interface (GUI) 54*c*, capable of performing two way communication with a device user.

In this regard, the device can include functionality for allowing a user to select various operating modes. Several variables which can be presented to a device user can include, for example, the ability to select the runtime of the blower unit; to selectively operate the fan in a high, medium and low setting; to operate the fan without the heating element; and/or to adjust the temperature of the heating element. Of course, any number of other settings are also contemplated.

Figure 6:
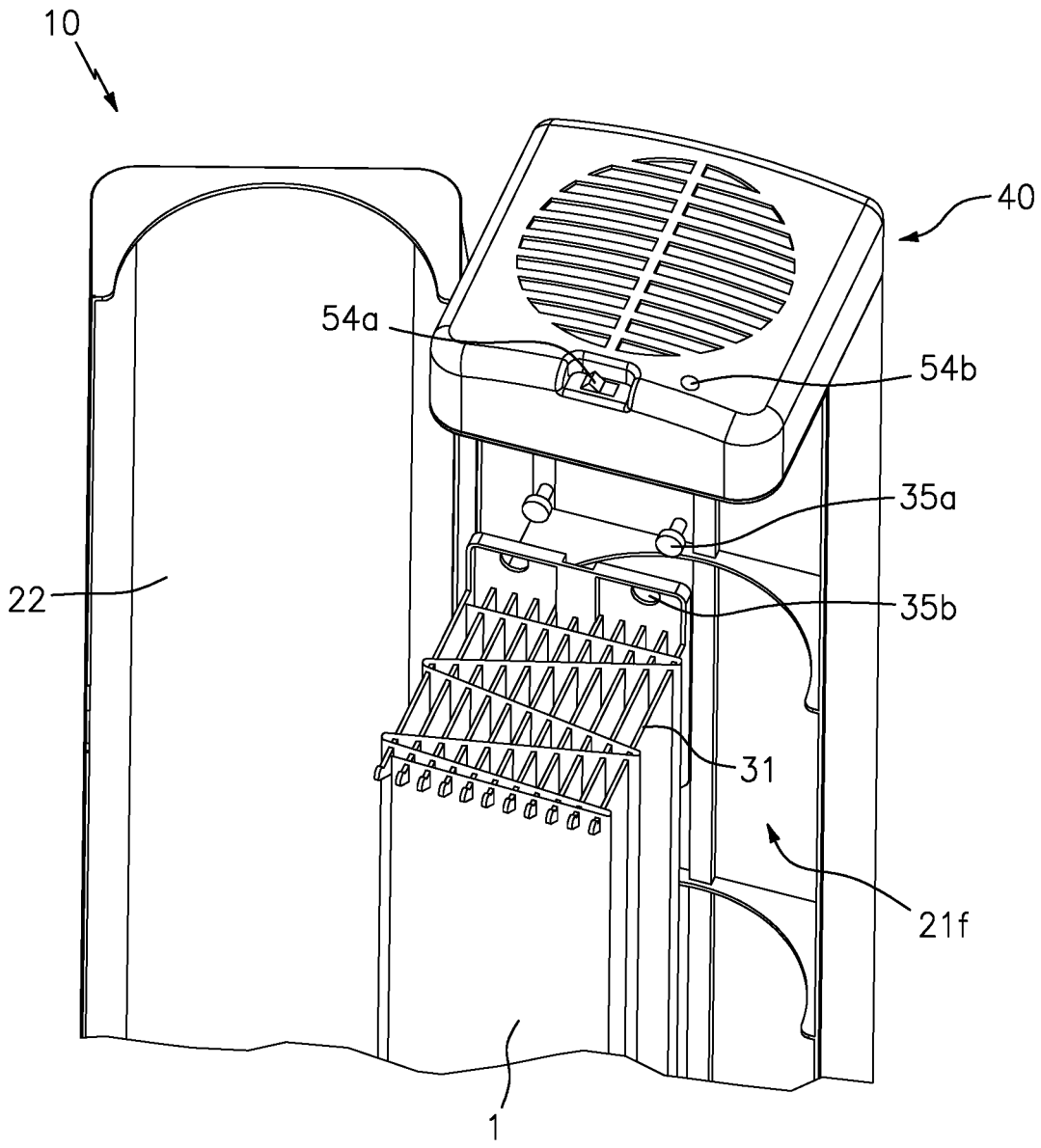
FIG. 6 is a perspective view of the hair extension drying device in operation, in accordance with one embodiment of the invention.
Figure 7:
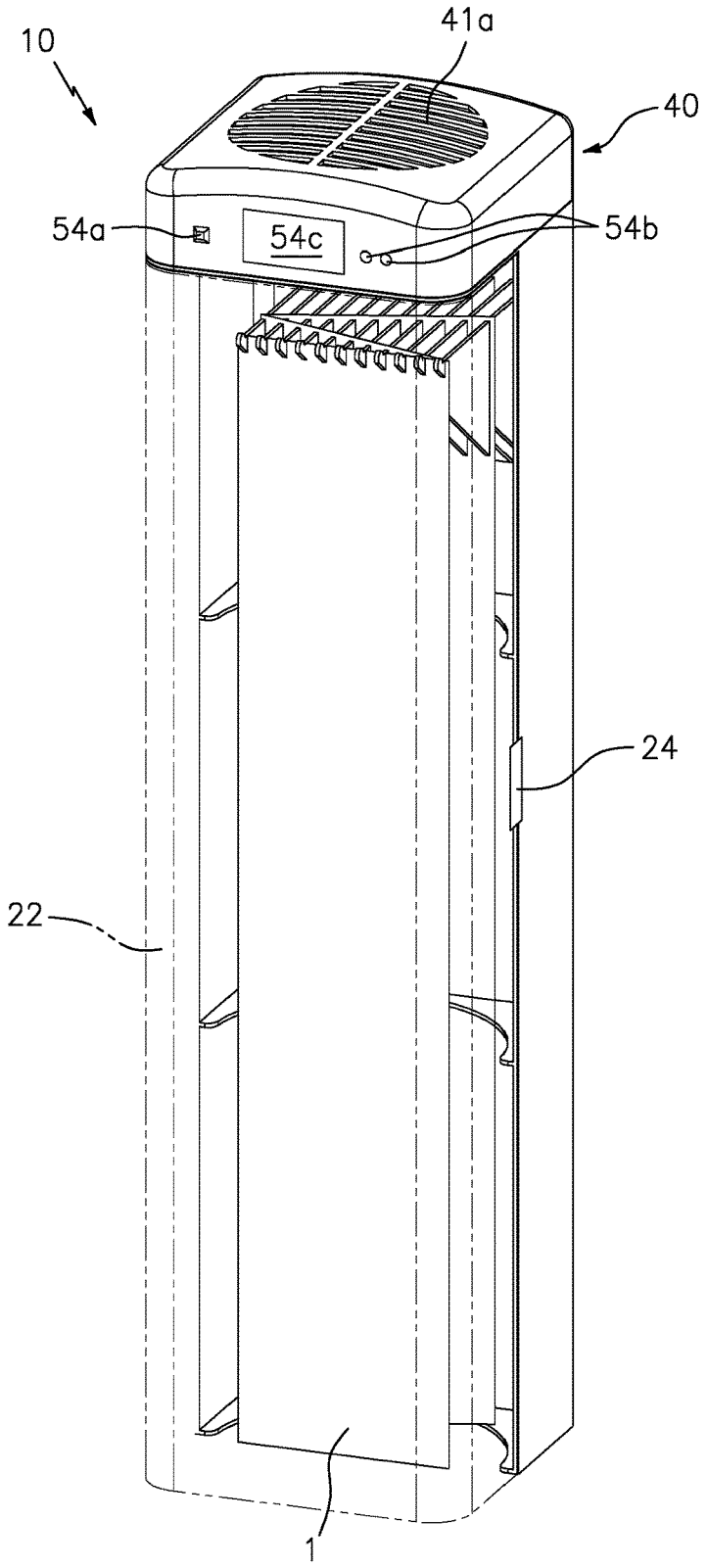
FIG. 7 is another perspective view of the hair extension drying device in operation, in accordance with one embodiment of the invention.

FIGS. 6 and 7 illustrate one embodiment of the device 10 in operation. As shown, any number of hair extensions 1 can be placed onto the slats 31 of the hanger unit 30. Once positioned thereon, the hanger unit can be secured within the main body 20 via the connectors, as described above, and the door 22 can be closed. Finally, the user can activate the blower unit via one or more of the buttons 54*a* (FIG. 6) and/or the display 54*c* (FIG. 7) to generate airflow through the main body in order to completely dry the inserted hair extension without causing damage to the same.

As described herein, one or more elements of the hair extension drying device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 20 and the blower unit housing, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A device for drying hair extensions, said device comprising:

an elongated main body having a top wall, a plurality of side walls, a door and an interior space;

a central aperture that is disposed along the top wall of the main body and terminating at the interior space;

a hanger unit that is positioned within the interior space of the main body, said hanger unit consisting of:

a mounting plate that is configured to engage one of the plurality of side walls along the interior space of the main body, and a plurality of slats that are constructed from a heat absorbing material and having a raised stopper portion along a distal end thereof, each of the plurality of slats are arranged in a parallel orientation to each other, and are at a diagonal angle with respect to the mounting plate; and a blower unit that includes a housing body and a blower output, said housing being secured to the top wall of the main body, and said blower output being aligned with the central aperture, wherein the hanger unit is positioned at a location directly beneath and adjacent to the blower unit.

2. The device of claim 1, wherein the blower unit comprises:

a fan that is positioned within the housing body;

an input/output member that is in communication with the housing body; and an internal controller that is positioned within the housing body.

3. The device of claim 2, wherein the blower unit further comprises:

a heating element that is positioned within the housing body at a fan output location.

4. The device of claim 3, wherein the internal controller includes a timer that is configured to automatically disengage an operation of one or both of the fan and the heating element upon a passage of a predetermined period of time.

5. The device of claim 3, wherein the controller and input/output member are configured to selectively operate one or both of the fan and the heating element.

6. The device of claim 3, wherein the input/output member includes a push button switch.

7. The device of claim 3, wherein the input/output member includes a graphic user interface for performing two way communication between the internal controller and a user.

8. The device of claim 1, wherein the door is constructed from a clear material and is hingedly secured to one of the plurality of side walls.

9. The device of claim 1, wherein the heat absorbing material is metal.

* * * * *